US009692174B1

(12) United States Patent
Yu

(10) Patent No.: US 9,692,174 B1
(45) Date of Patent: Jun. 27, 2017

(54) CIRCULAR RAPID JOINT CONNECTOR

(71) Applicant: T-CONN PRECISION CORPORATION, New Taipei (TW)

(72) Inventor: Chien-Yi Yu, New Taipei (TW)

(73) Assignee: T-CONN PRECISION CORPORATION, New Taipei (TW)

( * ) Notice: Subject to any disclaimer, the term of this patent is extended or adjusted under 35 U.S.C. 154(b) by 0 days.

(21) Appl. No.: 14/972,432

(22) Filed: Dec. 17, 2015

(51) Int. Cl.
*H01R 13/627* (2006.01)
*H01R 13/622* (2006.01)

(52) U.S. Cl.
CPC ..... *H01R 13/622* (2013.01)

(58) Field of Classification Search
CPC ..... H01R 13/6271; H01R 13/6275; H01R 13/6582; H01R 13/6272
USPC ..... 439/352, 353, 357, 358
See application file for complete search history.

(56) References Cited

U.S. PATENT DOCUMENTS 4,548,455 A * 10/1985 Ezure ..... H01R 13/627 439/152
5,486,123 A * 1/1996 Miyazaki ..... H01R 13/15 439/825
6,056,577 A * 5/2000 Blanchet ..... H01R 13/639 439/352
6,093,043 A * 7/2000 Gray ..... H01R 13/622 439/352
6,517,373 B2 2/2003 Finke et al.
RE38,294 E * 11/2003 Nattel ..... H01R 9/03 174/59
7,070,447 B1 * 7/2006 Montena ..... H01R 24/564 439/578
7,351,101 B1 * 4/2008 Montena ..... H01R 9/0521 439/584
7,357,672 B2 * 4/2008 Montena ..... H01R 9/0524 174/59
7,806,714 B2 * 10/2010 Williams ..... H01R 13/639 439/265
7,892,004 B2 * 2/2011 Hertzler ..... H01R 13/5219 439/312
8,007,314 B2 * 8/2011 Chawgo ..... H01R 9/0524 439/548
8,651,887 B2 * 2/2014 Zhang ..... H01R 13/6275 439/352
8,708,731 B2 * 4/2014 Chatelus ..... H01R 13/6271 439/350
9,425,548 B2 * 8/2016 Van Swearingen .. H04B 5/0012
(Continued)

*Primary Examiner* — Abdullah Riyami
*Assistant Examiner* — Thang Nguyen
(74) *Attorney, Agent, or Firm* — Bacon & Thomas, PLLC

(57) ABSTRACT

A circular rapid-joint connector, which includes a sliding bush with multiple extension sections and recession areas provided on an end thereof; an elastic element provided on the inner edge of the sliding bush; a holding unit joined with the sliding bush movably, the outer edge thereof having a limiting unit capable of limiting each of the extension sections; and a connector plug penetrating into the sliding bush and joined with the holding unit. In assembling, direct docking with a connection socket by the connector plug is available for the connection socket to push away the sliding bush. After the connection socket and the connector plug are snap-fitting, the sliding bush is pushed back by the elastic element automatically, such that the sliding bush is locked in the outer edge of the connection socket to complete the operation of assemblage.

8 Claims, 15 Drawing Sheets

(56) References Cited

U.S. PATENT DOCUMENTS

| | | | | |
|---|---|---|---|---|
| 2006/0051999 | A1* | 3/2006 | Allemann | H01R 13/622<br>439/320 |
| 2009/0269981 | A1* | 10/2009 | Haruna | H01R 9/037<br>439/607.04 |
| 2011/0151714 | A1* | 6/2011 | Flaherty | H01R 13/6277<br>439/578 |
| 2011/0237123 | A1* | 9/2011 | Burris | H01R 13/6277<br>439/578 |
| 2011/0237124 | A1* | 9/2011 | Flaherty | H01R 13/6277<br>439/578 |

* cited by examiner

CIRCULAR RAPID JOINT CONNECTOR

BACKGROUND OF THE INVENTION

Field of the Invention

The invention is an improvement for a circular rapid-joint connector, particularly relating to one which may be in direct docking with a connection socket by a connector play when using, such that effects of rapid joint, solid joining, rapid disassembling, simple structure and facile of use are accomplished.

Descriptions of the Related Art

Conventionally, the "Circular Connector", U.S. Pat. No. 6,517,373 B2, includes a first connector element and a second connector element each of which has a first contact inset or a respective second contact inset in which, around the first contact inset of the first connector element, a sleeve-shaped latch segment is arranged from which, running along the longitudinal direction of the connector, one or more resilient latch flanges with latch tabs are formed that are appropriate for locking onto a ring-shaped groove formed on the inner side of the second connector element (locking position) and in which the first connector element includes an outer directly manually operated sleeve-shaped actuation slide, which can be slid back against a spring force along the longitudinal direction of the connector (unlocking position) and is adapted to actuate one or more sliding supports as locking elements, which can be slid along the longitudinal direction of the connector under a section of the latch flanges and are appropriate for supporting the latch flanges (locking position), characterized in that the latch flanges formed from the latch segment are integrally fixed to an end thereof in a manner connecting rearward toward the actuation slide, that the sliding supports are formed from an end of the actuation slide and are directed directly toward the free ends of the latch segments, wherein the sliding supports extend from outside of the latch flanges essentially beneath their free ends only, when the actuation slide is pushed forward under the force of the spring.

From the cited patent described above, after the plug and the socket are docked, the actuation slide has to be pushed further in order for inserting the sliding supports beneath the latch flanges, such that the latch tabs are pushed and fastened into the ring-shaped groove, so that the operation of insertion and latching may be accomplished. As a result, cumbersome insertion procedure and complex structure will inhibit rapid connection in use of the conventional connector.

In view of this, the inventor has researched and developed an improved circular rapid-joint connector in order to improve the above conventional connector with respect to various shortages thereof.

SUMMARY OF THE INVENTION

A main objective of the invention is that, in assembling, direct docking with a corresponding connection socket by a connector plug is available for the connection socket to push away a sliding bush. After the connection socket and the connector plug are snap-fitting, the sliding bush is pushed back by an elastic element automatically, such that the sliding bush is locked in the outer edge of the connection socket to complete action of assemblage. In disassembling, the sliding bush is pulled backwards such that the sliding bush is not limited in the outer edge of the connection socket any more. After that, a force may be applied to remove the connector plug from the connection socket directly, and the fitting of the extension sections, the recession areas and the limiting unit may result for the sliding bush to be locked without rotation, so that the effects of being capable of rapid assembling, solid joining, rapid disassembling, simple structure and facile of use are accomplished.

In order to achieve the above objectives, the invention is an improvement for a circular rapid-joint connector, which includes: a sliding bush with multiple extension sections and recession areas provided on an end thereof; an elastic element provided on the inner edge of the sliding bush; a holding unit joined with the sliding bush movably, the outer edge thereof having a limiting unit capable of limiting each of the extension sections; and a connector plug penetrating into the sliding bush and joined with the holding unit.

In the embodiment described above, a containing area capable of accommodating the elastic element is provided on the inner edge of the sliding bush, an end of the sliding bush has multiple buckle holes engaged with the holding unit, and the inner edge of another end of the sliding bush has a stop portion abutting against the connector plug.

In the embodiment described above, the holding unit comprises a sleeve, a collar provided in the sleeve, a clip provided outside of the collar, and a locking bush joining with the sleeve and constricting the clip, while the limiting unit is provided on the outer edge of the sleeve.

In the embodiment described above, the limiting unit comprises multiple bumps, each of which mates with the respective recession area, and the bumps are formed with a respective limiting slot therebetween for each of the extension sections to mate with.

In the embodiment described above, the limiting unit comprises a rib ring provided on the sleeve, and multiple insertion slots which are docked with the respective extension sections are provided thereon.

In the embodiment described above, the limiting unit comprises multiple prolonged plates, each of which mates with the respective recession area, and the prolonged plates are formed with a respective groove therebetween for each of the extension sections to mate with.

In the embodiment described above, an end of the clip has multiple adjacent clamping sheets.

In the embodiment described above, the edge of the clip has a notch portion.

In the embodiment described above, the outer edge of the sleeve has buckles docking with the buckle holes respectively, and an end of the sleeve has multiple adjacent elastic pieces, the inner surface of each of the elastic pieces being provided with a stop ring, and the inner edge of the sleeve is provided with a first internal thread portion joined with the connector plug, moreover, a first external thread portion is provided on the outer edge of the sleeve where each of the elastic pieces is adjacent thereto, while the inner edge of the locking bush is provided with a second internal thread portion joined with the first external thread portion.

In the embodiment described above, an end of the connector plug has a top portion, another end has a second external thread portion joined with the first internal thread portion, and the connector play is provided with multiple insertion terminals therein, while one side of the top portion is provided with an annular plate abutting against the stop portion, and the top portion is provided with a ditch thereon annularly.

In the embodiment described above, the top portion is provided with a marking portion thereon, and the connector plug is provided with a guiding portion therein.

BRIEF DESCRIPTION OF THE DRAWINGS

FIGS. 5 to 10A are schematic diagrams showing assemblage of the invention.

FIGS. 12-1 to 12-4 are schematic diagrams showing operation of the invention.

DETAILED DESCRIPTION OF THE PREFERRED EMBODIMENT

Figure 1:
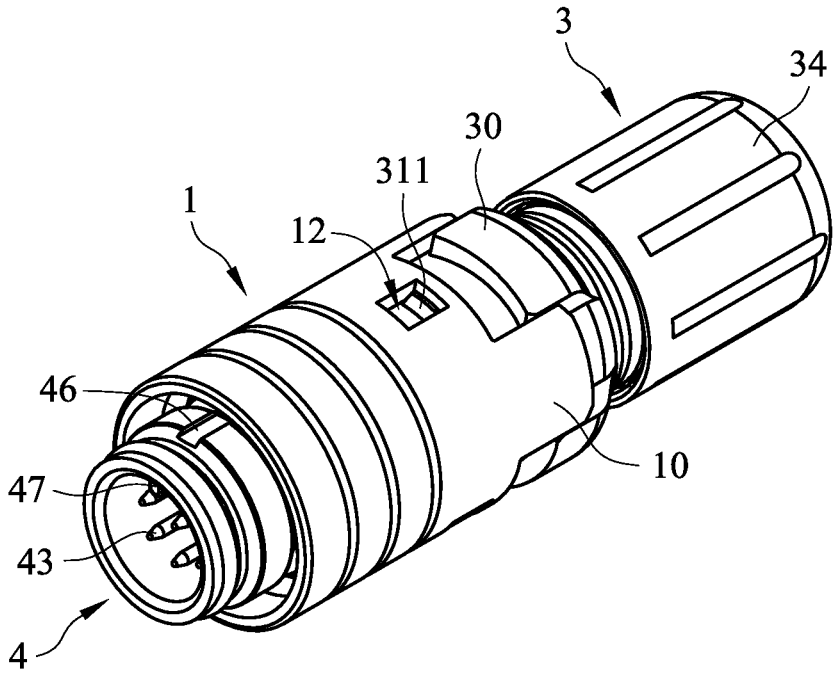
FIG. 1 is a schematic diagram showing the appearance of the invention.
Figure 2:
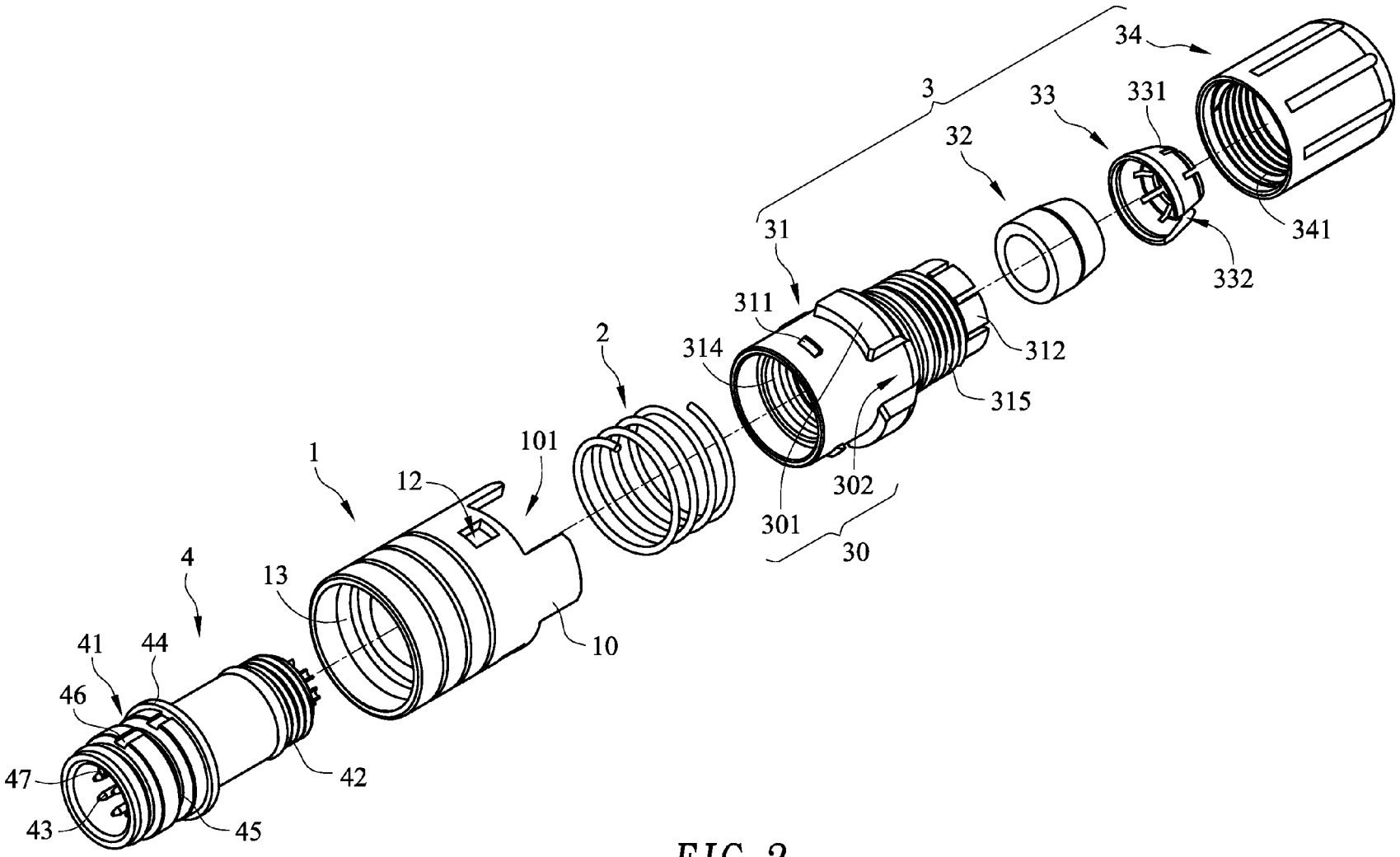
FIG. 2 is an exploded schematic diagram showing elements of the invention.
Figure 3:
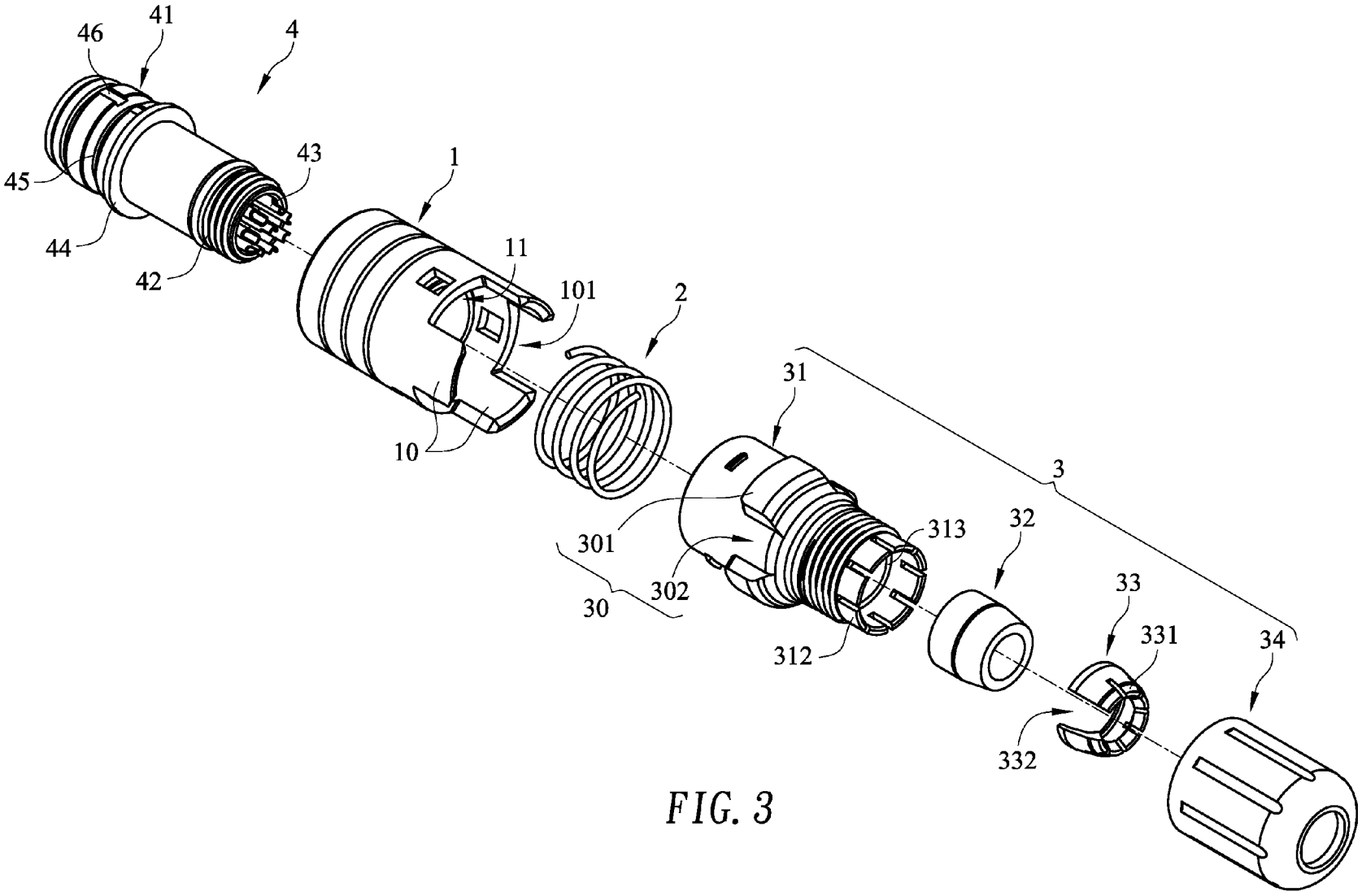
FIG. 3 is another exploded schematic diagram showing elements of the invention.
Figure 4:
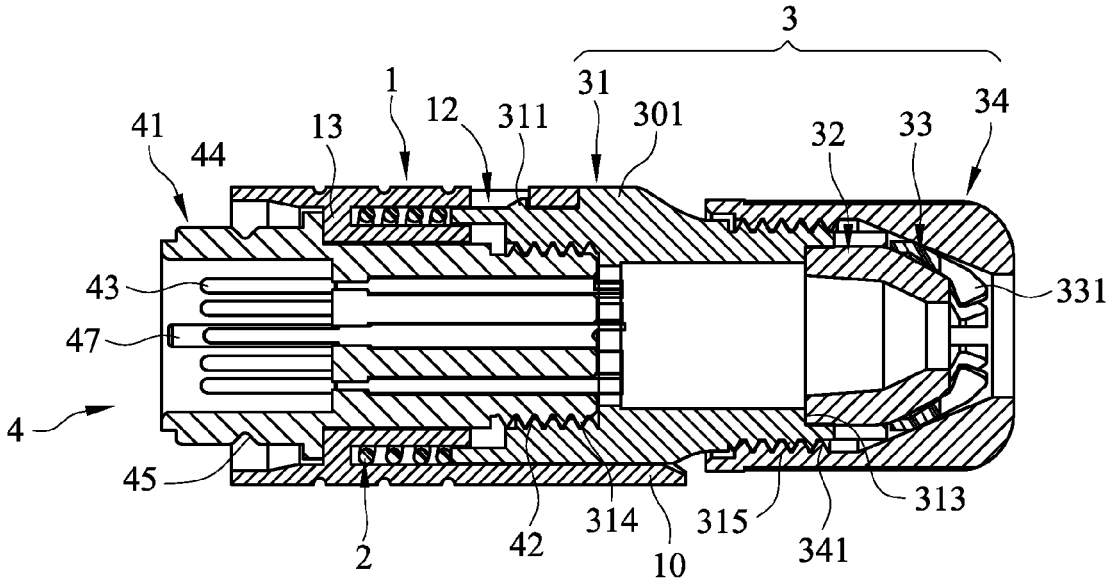
FIG. 4 is a schematic diagram showing a cross section of the invention.
Figure 5:
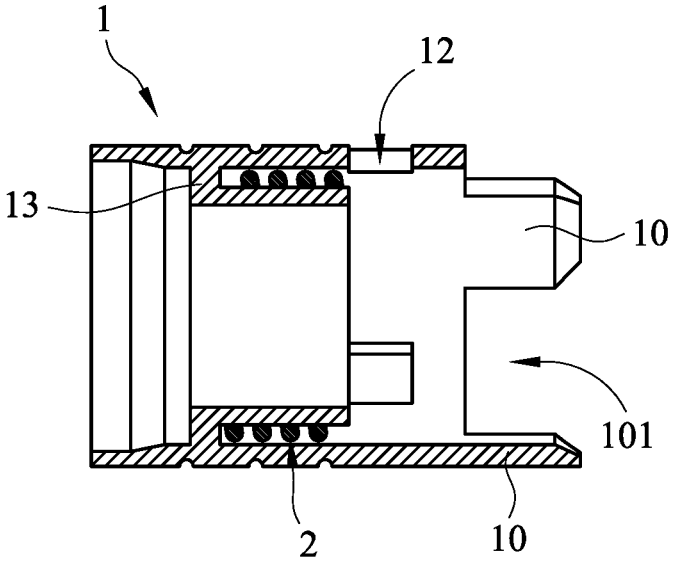
Figure 6:
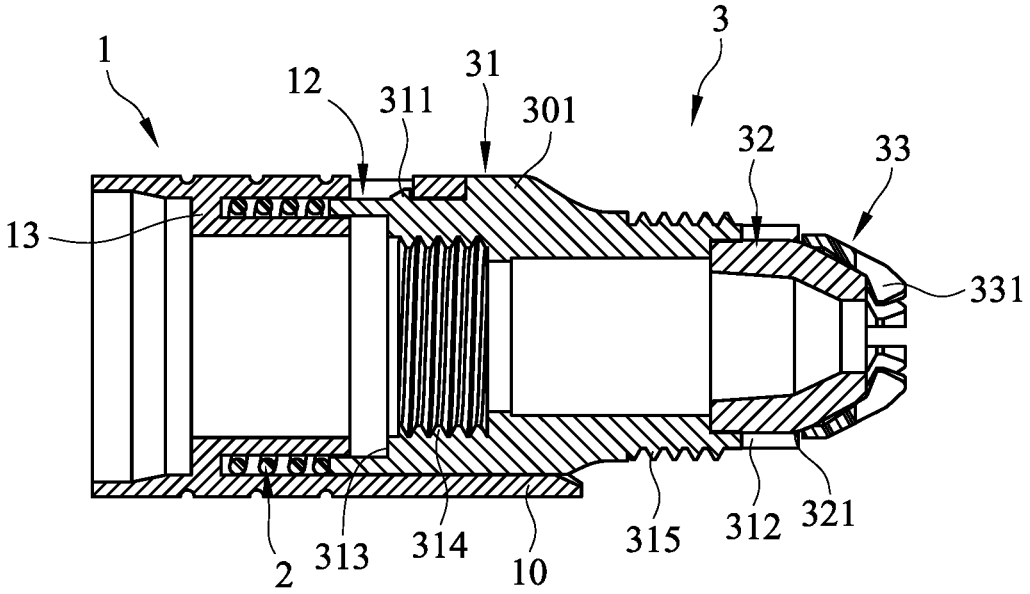
Figure 7:
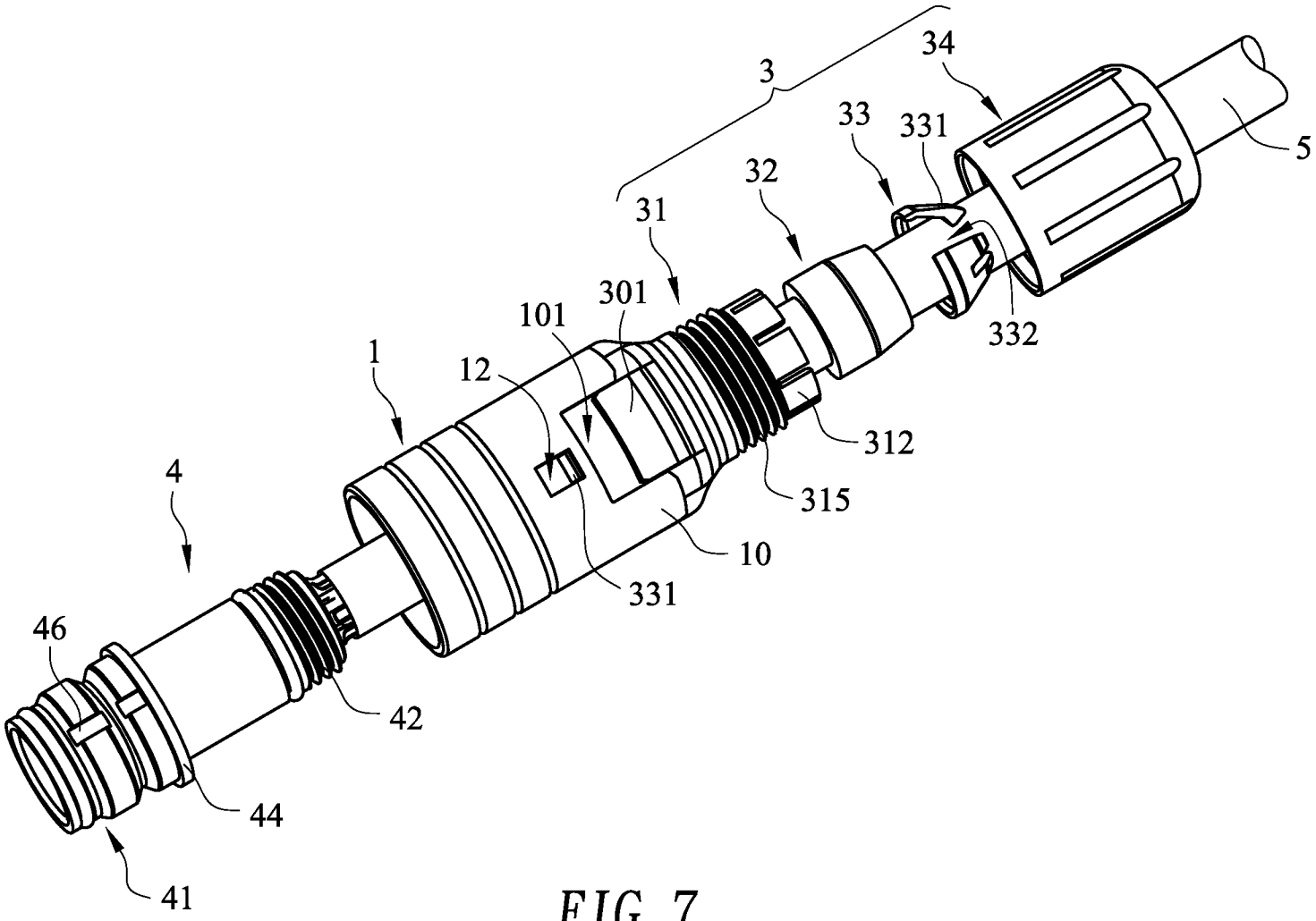
Figure 8:
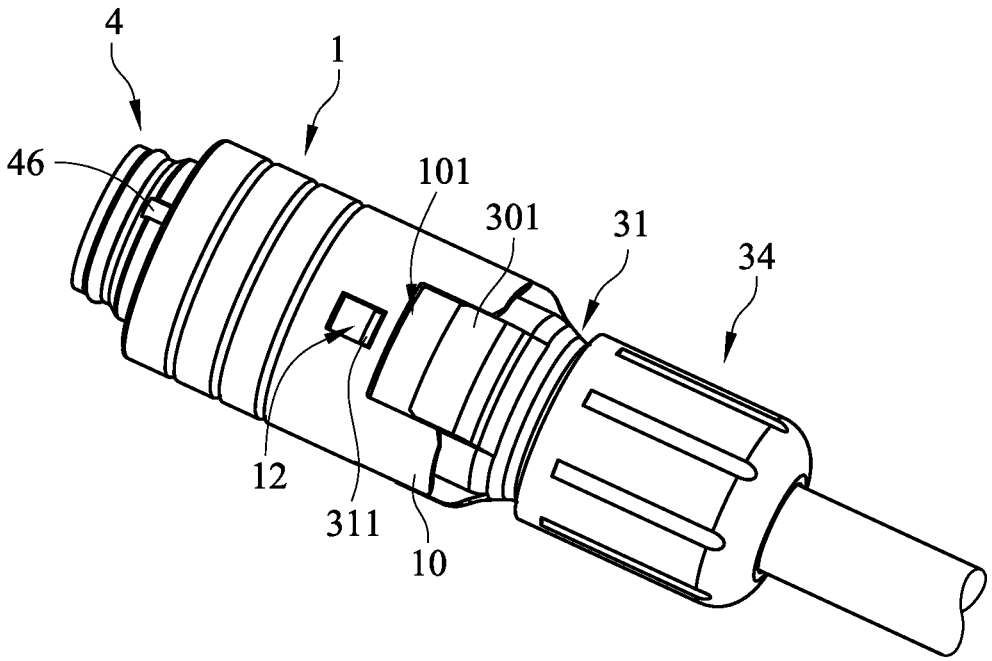
Figure 9:
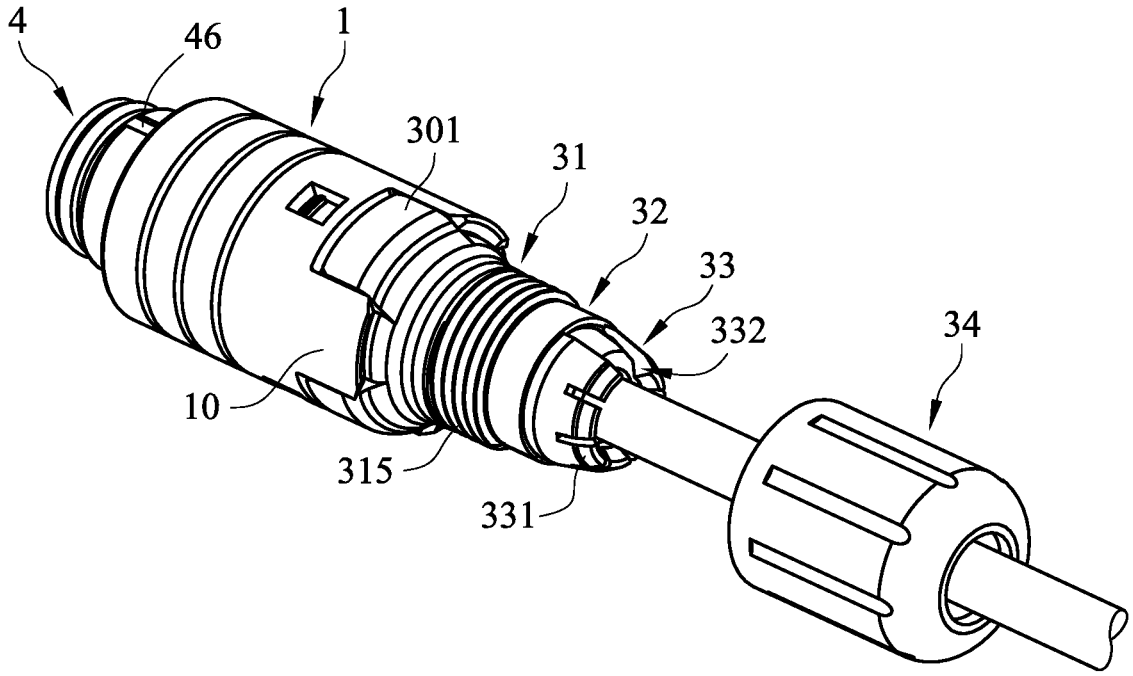

For thorough understanding of objectives, features and effects of the invention, the invention is described in detail as following in conjunction with attached drawings by means of embodiments.

Refer to FIGS. 1, 2, 3 and 4, which are a schematic diagram showing appearance of the invention, an exploded schematic diagram showing elements of the invention, another exploded schematic diagram showing elements of the invention, and a schematic diagram showing a cross section of the invention, respectively. As shown in the figures, the invention is an improvement for a circular rapid-joint connector comprised at least of a sliding bush 1, an elastic element 2, a holding unit 3 and a connector plug 4.

The sliding bush 1 has multiple extension sections 10 provided on an end thereof; the extension sections 10 have a respective recession area 101 formed therebetween; and the inner edge of the sliding bush 1 is provided with a containing area 11, and an end of the sliding bush 1 has multiple buckle holes 12, while the inner edge of another end of the sliding bush 1 has a stop portion 13.

The elastic element 2 is provided in the containing area 11 of the inner edge of the sliding bush 1.

The holding unit 3 is joined with the sliding bush 1 movably, the outer edge thereof having a limiting unit 30 capable of limiting each of the extension sections. The holding unit 3 comprises a sleeve 31, a collar 32 provided in the sleeve 31, a clip 33 provided outside of the collar 32, and a locking bush 34 joined with the sleeve 31 and constricting the locking bush 34 of the clip 33. The limiting unit 30 is provided on the outer edge of the sleeve 31. The limiting unit 30 comprises bumps 301 mating with respective recession areas 101. The bumps 301 are formed with a respective limiting slot 302 therebetween for each of the extension sections 10 to mate with. Wherein the outer edge of the sleeve 31 has buckles 311 docked with respective buckle holes 12, and the buckle holes 12 of the sliding bush 1 are larger than the buckles 311 of the sleeve 31. An end of the sleeve 31 has multiple adjacent elastic pieces 312. The inner surface of each of the elastic pieces 312 is provided with a stop ring 313. The inner edge of the sleeve 31 is provided with a first internal thread portion 314. Furthermore, the outer edge of the sleeve 31 adjacent to each of the elastic pieces 312 is provided with a first external thread portion 315. An end of the clip 33 has multiple adjacent clamping sheets 331. An edge of the clip 33 is provided with a notch portion 332. Moreover, the inner edge of the locking bush 34 is provided with a second internal thread portion 341 joined with the first external thread portion 315.

The connector plug 4 is penetrated into the sliding bush 1 and joined with the holding unit 3, while an end of the connector plug 4 has a top portion 41, another end has a second external thread portion 42 joined with the first internal thread portion 314, and the connector plug 4 is provided with multiple insertion terminals 43 therein. Moreover, one side of the top portion 41 is provided with an annular plate 44 abutting against the stop portion 13, and the top portion 41 is provided with a ditch 45 thereon. In addition, the top portion 41 is provided with a marking portion 46 thereon, and the connector plug 4 is provided with a guiding portion 47 therein.

Figure 10A:
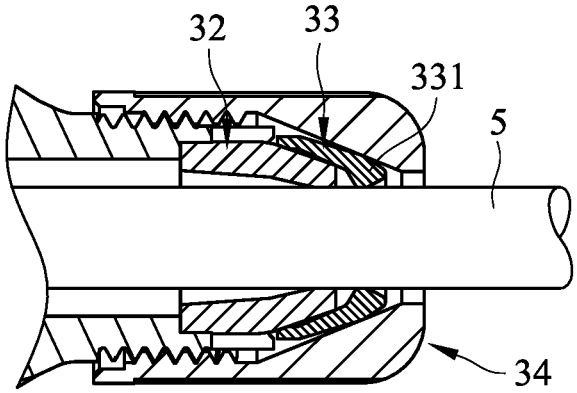
Figure 10B:
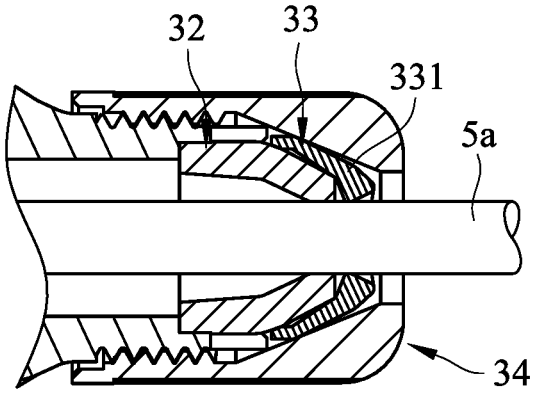
FIG. 10B is a schematic diagram showing another assemblage of the invention.
Figure 11:
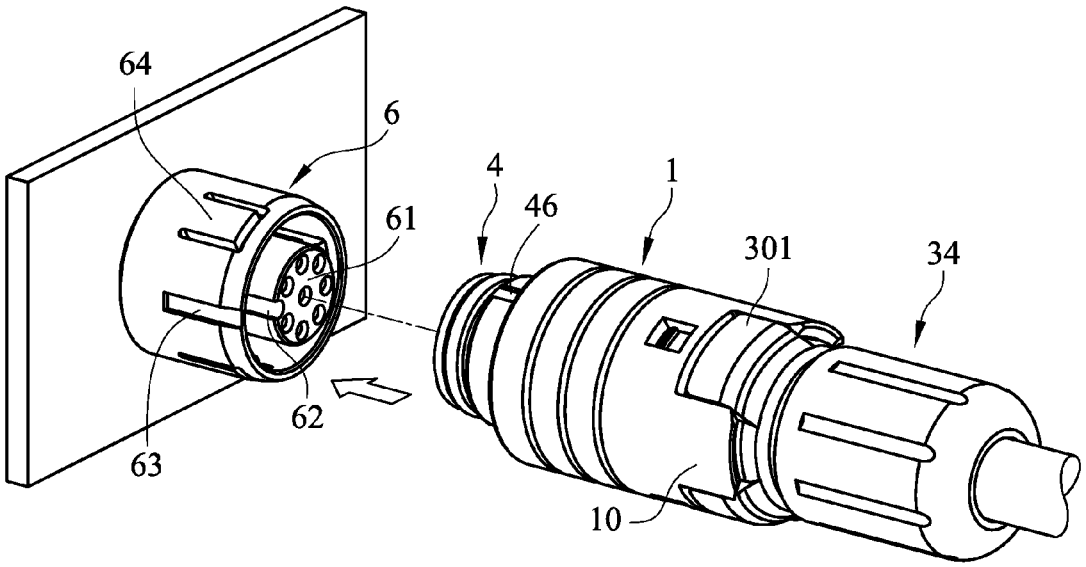
FIG. 11 is a schematic diagram showing usage of the invention.
Figures 1, 12:
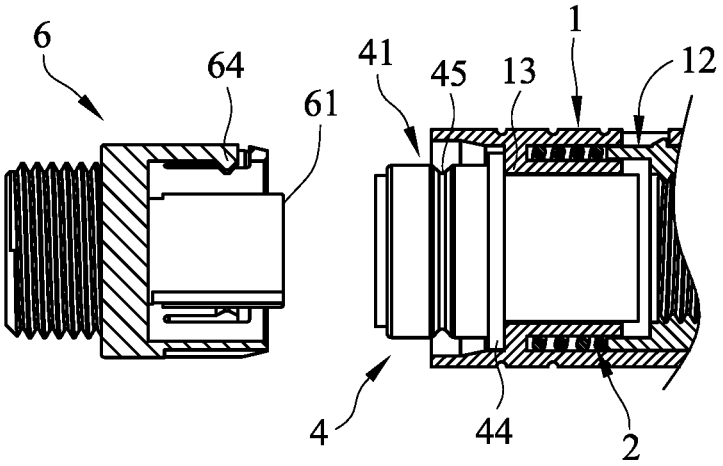
Figures 2, 12:
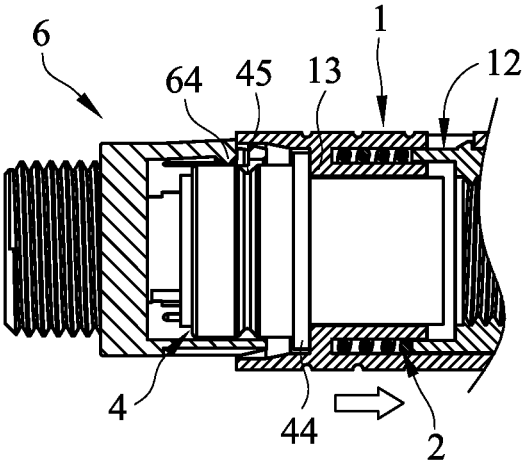
Figures 3, 12:
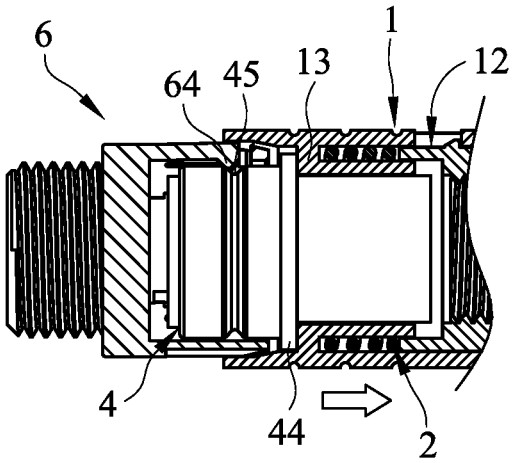
Figures 4, 12:
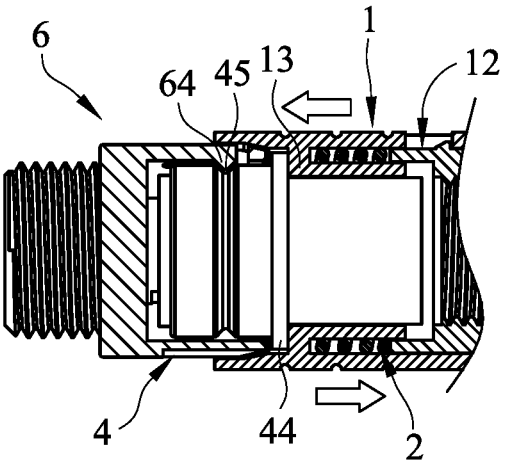
Figure 13:
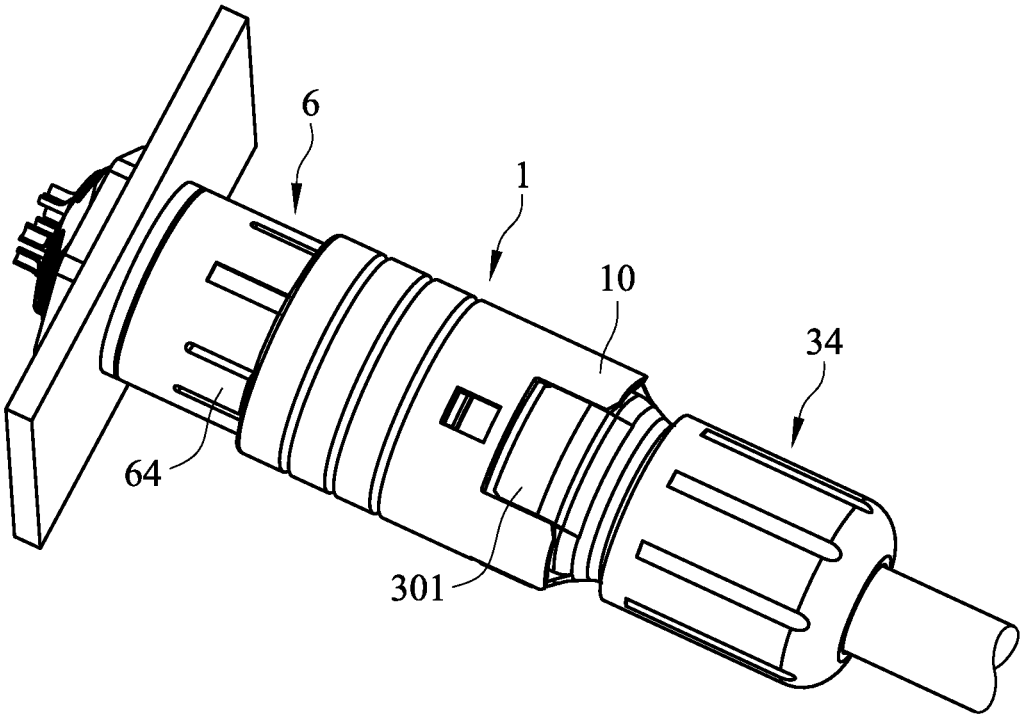
FIG. 13 is a schematic diagram showing the invention after insertion with a connection socket.

Refer to FIGS. 5, 6, 7, 8, 9, 10A and 10B, which are schematic diagrams showing assemblage of the invention and a schematic diagram showing another assemblage of the invention. As shown in the figures, in assemblage for the invention, the elastic element 2 may be disposed in the containing area 11 on the inner edge of the sliding bush 1, and the buckle holes 12 of the sliding bush 1 are docked with the respective buckles 311 of the sleeve 31, such that the extension sections 10 and the recession areas 101 of the sliding bush 1 are mated with the respective limiting slots 302 and the bumps 301 mutually. Moreover, the buckle holes 12 of the sliding bush 1 are larger than the buckles 311 of the sleeve 31, so that the sliding bush 1 is movable on the sleeve 31. Moreover, the sliding bush 1 can only move forwards or rearwards, but it cannot move leftwards, rightwards by fitting each of the extension sections 10, the recession areas 101, the limiting slot 301 and the bumps 301. After that, a wire 5 is used to penetrate through the locking bush 34, the clip 33, the collar 32, the sliding bush 1 and the sleeve 31 for the wire 5 to be connected with each of the insertion terminals 43 of the connector plug 4. Then, the second external thread portion 42 of the connector plug 4 is joined with the first internal thread portion 314 of the sleeve 31, followed by providing the collar 32 between the elastic pieces 312 on an end of the sleeve 31 for the edge of the collar 32 to be locked by the stop ring 313. Subsequently, the clip 33 is harnessed around the outer edge of the collar 32. Finally, the locking bush 34 is joined with the first external thread portion 315 of the sleeve 31 by the second internal thread portion 341 thereof for the inner edge of the locking bush 34 to constrict the outer edge of the clip 33. In turn, the clip 33 takes advantage of fitting between the clamping sheets 331 and the notch portion 332 to form a stable clamping force toward jacket of the wire 5 in order to prevent the wire 5 from escape. Moreover, the clamping characteristic function of the clip 33 may be utilized in practical use, such that it is applicable to wires 5, 5*a* of different wire diameters. As it is applicable to the wire 5 of a wire diameter having larger diameter, the locking bush 34 is locked more deeply in conjunction with the clip 33 (as shown in FIG. 10A). As it is applicable to the wire 5*a* of a wire diameter having smaller diameter, the locking bush 34 is locked shallower in conjunction with the clip 33 (as shown in FIG. 10B). As such, the assemblage is accomplished.

Refer to FIGS. 11, 12-1 to 12-4, and 13, which are a schematic diagram showing operation of the invention, schematic diagrams showing actions of assemblage and disassemblage of the invention, and a schematic diagram showing the invention after insertion with a connection socket. As shown in the figures, the invention may be inserted into a corresponding connection socket 6 in use, while correspond to the socket body 61 of the connection seat 6 by the connector plug 4 in docking, and correspond to the marking portion 63 of the connection socket 6 by the marking portion 46 of the connector plug 4, thereby the guiding portion 47 of the connector plug 4 corresponds to groove 62 of the connection socket 6 in order to identify insertion direction, such that incorrect insertion is avoided. As the top portion 41 of the connector plug 4 is docked to socket body 61, the periphery of the top portion 41 will withstand each buckle 64 of the connection socket 6 for each buckle 64 to be opened. In the mean time, an end of each buckle 64 will abut against the end edge of the sliding bush 1, such that the sliding bush 1 is pushed toward the holding unit 3 (rearwards as indicated by the arrow) and compresses the elastic element 2, and be removed from the end edge of the sliding bush 1 after each buckle 64 enters the ditch 45 of the top portion 41, while the sliding bush 1 is pushed back toward the top portion 41 (forwards as indicated by the arrow) automatically due to restitution force, such that the sliding bush 1 is locked on the outer edge of each buckle 64 of the connection socket 6 to limit each buckle 64 for each insertion terminal 43 to be inserted into the socket body 61, and thereby, to accomplish insertion operation.

In disassembling, the sliding bush 1 is pulled toward the holding unit 3 (rearwards), such that the sliding bush 1 no longer limited to the outer edge of each buckle 64. After that, a force may be applied to disassemble the connector plug 4 from the connection socket 6 directly by the user.

Moreover, as the sliding bush 1 moves forwards or rearwards, the sliding bush 1 is mated with the limiting slots 302 and bumps 301 by the respective extension sections 10 and recession areas 101, such that the sliding bush 1 is capable of moving forwards or rearwards only, but it is incapable of rotating leftwards or rightwards during movement on the sleeve 31 to maintain its position of the sliding bush 1 accordingly for operation of use thereof to be more stable.

Figure 14:
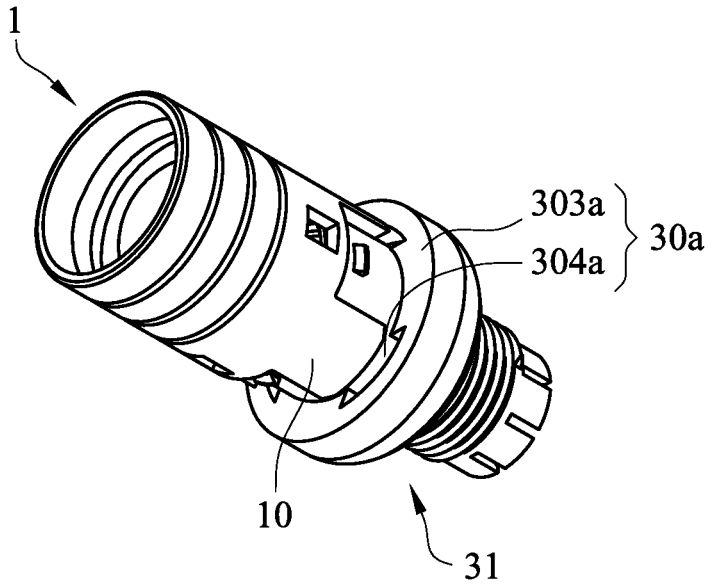
FIG. 14 is a schematic diagram showing another type of the limiting unit of the invention.

Refer to FIG. 14, which is a schematic diagram showing another type of a limiting unit of the invention. As shown in the figure, in addition to the structure described above, the limiting unit 30 of the invention may be also of the structural type in this example, which differs in that the limiting unit 30*a* comprises a rib ring 303*a* provided on the sleeve 31, on which multiple inserting slots 304*a* docked with the respective extension sections 10 are provided. Thereby, the extension sections 10 may be inserted into the respective inserting slots 304*a* while the sliding bush 1 moves forwards, rearwards. Therefore, the sliding bush 1 is capable of moving forwards, rearwards only, but it is incapable of rotating leftwards, rightwards during movement on the sleeve 31 to maintain the position of the sliding bush 1 accordingly for operation of use thereof to be more stable.

Figure 15:
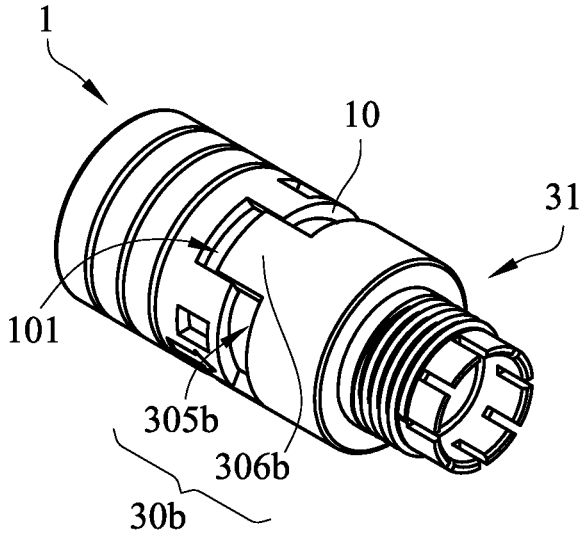
FIG. 15 is a schematic diagram showing a further type of the limiting unit of the invention.

Refer to FIG. 15, which is a schematic diagram showing a further type of a limiting unit of the invention. As shown in the figure, in addition to the structure described above, the limiting units 30, 30*a* may also be of the structural type in this example, which differs in that the limiting unit 30*b* comprises multiple prolonged plates 305*b* mated with the respective recession areas 101, and the prolonged plates 305*b* are formed with a respective groove 306*b* therebetween for each of the extension sections 10 to mate with. Thereby, the extension sections 10 and the recession areas 101 may be mated with the respective prolonged plates 305*b* and grooves 306*b* mutually when the sliding bush 1 moves forwards or rearwards, such that the sliding bush 1 is capable of moving forwards or rearwards only, but it is incapable of rotating leftwards or rightwards during movement on the sleeve 31 to maintain its position of the sliding bush 1 accordingly for operation of use thereof to be more stable.

Figure 16:
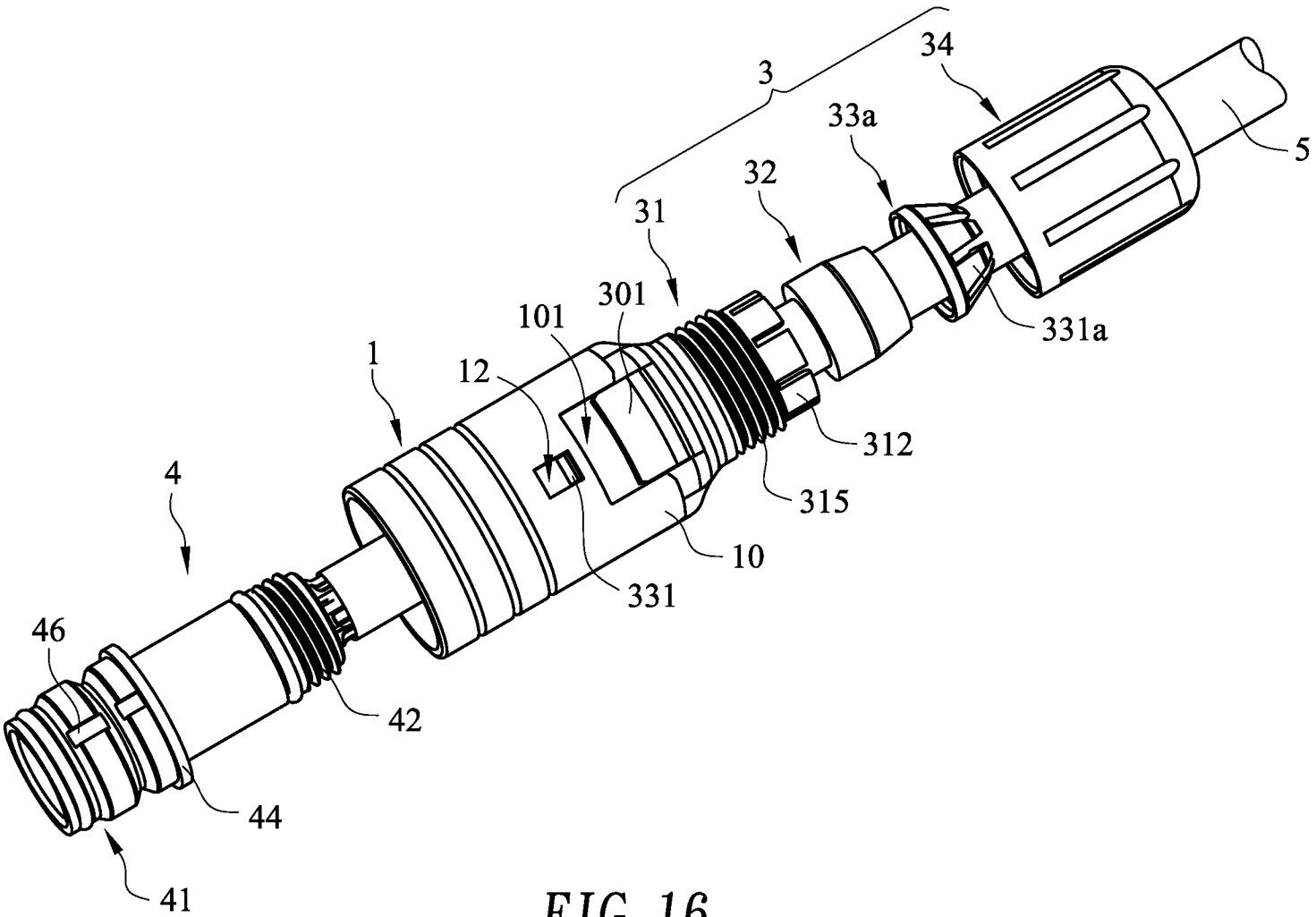
FIG. 16 is a schematic diagram showing another type of the clip of the invention.

Refer to FIG. 16, which is a schematic diagram showing another type of a clip of the invention. As shown in the figure, in addition to the structure described above, the clip 33 of the invention may be of the structural type in this example, which differs in that an end of the clip 33*a* has multiple adjacent clamping sheets 331*a*, and the structure of the notch portion 332 is omitted in this example. However, the inner edge of the locking bush 34 may also be used to constrict the outer edge of the clip 33*a* during operation, such that the clip 33*a* takes advantage of each of the clamping sheet 331*a* to form a stable clamping ability on the jacket of the wire 5, such that the applicability to wires of different diameters may also be achieved.

In summary, with the description above, the invention can achieve actually the expected objectives of the invention, such that in assembling, direct docking with the connection socket by the connector plug is available for the connection socket to push away the sliding bush. After the connection socket and the connector plug are snap-fitting, the sliding bush is pushed back by the elastic element automatically, such that the sliding bush is locked to the outer edge of the connection socket to complete operation of assemblage. In disassembling, the sliding bush is pulled backwards such that the sliding bush is not limited to the outer edge of the connection socket any more. After that, a force may be applied to disassemble the connector plug from the connection socket directly, and the fitting of the extension sections, the recession areas and the limiting unit is utilized to limit and prevent the sliding bush from rotation. As a result, the effects of rapid assembling, solid joining, rapid disassembling, simple structure and ease of use are achieved.

While the description above are only preferred embodiments of the invention. Any equivalent modification made within the scope of claims of the invention shall be within the substantial scope of the invention.

What is claimed is:

1. An improved circular rapid-joint connector, including:

a sliding bush with multiple extension sections provided on an end thereof, the extension sections being formed with a respective recession area therebetween;

an elastic element provided on the inner edge of the sliding bush;

a holding unit joined with the sliding bush movably, the outer edge thereof having a limiting unit capable of limiting each of the extension sections, wherein the holding unit comprises a sleeve, a collar provided in the sleeve, a clip provided outside of the collar, and a locking bush joining with the sleeve and constricting the clip, while the limiting unit is provided on the outer edge of the sleeve; and a connector plug penetrating into the sliding bush and joined with the holding unit.

2. The improved circular rapid-joint connector as described in claim 1, wherein the limiting unit comprises multiple bumps, each of which mates with the respective recession area, and the bumps are formed with a respective limiting slot therebetween for each of the extension sections to mate with.

3. The improved circular rapid-joint connector as described in claim 1, wherein the limiting unit comprises a rib ring provided on the sleeve, and multiple insertion slots which are docked with the respective extension sections are provided thereon.

4. The improved circular rapid-joint connector as described in claim 1, wherein the limiting unit comprises multiple prolonged plates, each of which mates with the respective recession area, and the prolonged plates are formed with a respective groove therebetween for each of the extension sections to mate with.

5. The improved circular rapid-joint connector as described in claim 1, wherein an end of the clip has multiple adjacent clamping sheets, and the edge of the clip has a notch portion.

6. The improved circular rapid-joint connector as described in claim 1, wherein an end of the clip has multiple adjacent clamping sheets.

7. The improved circular rapid-joint connector as described in claim 1, wherein the outer edge of the sleeve has multiple buckles docking with the buckle holes respectively, and an end of the sleeve has multiple adjacent elastic pieces, the inner surface of each of the elastic pieces being provided with a stop ring, and the inner edge of the sleeve is provided with a first internal thread portion joined with the connector plug, moreover, a first external thread portion is provided on the outer edge of the sleeve where each of the elastic pieces is adjacent thereto, while the inner edge of the locking bush is provided with a second internal thread portion joined with the first external thread portion.

8. The improved circular rapid-joint connector as described in claim 7, wherein the buckle holes of the sliding bush are larger than the buckles of the sleeve.

* * * * *